US011577254B2

(12) United States Patent
Hannot et al.

(10) Patent No.: US 11,577,254 B2
(45) Date of Patent: Feb. 14, 2023

(54) ROLL FOR A ROLLER PRESS, AS WELL AS A ROLLER PRESS PROVIDED WITH SUCH A ROLL

(71) Applicant: WEIR MINERALS NETHERLANDS B.V., Venlo (NL)

(72) Inventors: Stephan David Arjan Hannot, Venlo (NL); René Van Der Ende, Venlo (NL)

(73) Assignee: WEIR MINERALS NETHERLANDS B.V., Venlo (NL)

( * ) Notice: Subject to any disclaimer, the term of this patent is extended or adjusted under 35 U.S.C. 154(b) by 35 days.

(21) Appl. No.: 16/968,043

(22) PCT Filed: Feb. 7, 2019

(86) PCT No.: PCT/NL2019/050077

§ 371 (c)(1),
(2) Date: Aug. 6, 2020

(87) PCT Pub. No.: WO2019/156558

PCT Pub. Date: Aug. 15, 2019

(65) Prior Publication Data

US 2021/0031206 A1 Feb. 4, 2021

(30) Foreign Application Priority Data

Feb. 8, 2018 (NL) ..... 2020403

(51) Int. Cl.
*B02C 4/30* (2006.01)
*B02C 4/08* (2006.01)

(52) U.S. Cl.
CPC ..... *B02C 4/305* (2013.01); *B02C 4/08* (2013.01)

(58) Field of Classification Search
CPC ..... B02C 4/30; B02C 4/06; B02C 4/305; B02C 4/08; B02C 4/02; B30B 3/005
(Continued)

(56) References Cited

U.S. PATENT DOCUMENTS 5,269,477 A * 12/1993 Buchholtz ..... B02C 4/305 241/293
5,927,627 A * 7/1999 Edson ..... B02C 4/08 241/159

(Continued)

FOREIGN PATENT DOCUMENTS

EP 0830897 A1 3/1998
EP 1502650 A1 2/2005

(Continued)

OTHER PUBLICATIONS

International search report of related application PCT/NL2019/050077, dated Jun. 3, 2019, 9 pages.

*Primary Examiner* — Shelley M Self
*Assistant Examiner* — Teresa A Guthrie
(74) *Attorney, Agent, or Firm* — Casimir Jones, S.C.; Brian F. Bradley

(57) ABSTRACT

A roll for a roller press suitable for comminution of granular material by interparticle crushing. The roll comprising a cylindrical body having an outer cylindrical pressing surface for use with an opposing roll in an interparticle crushing pressing nip and a plurality of outwardly extending wear-resistant surface studs positioned on the pressing surface. A strip element is provided on the outer cylindrical pressing surface of the cylindrical body.

11 Claims, 7 Drawing Sheets

(58) Field of Classification Search
USPC ..... 241/235; 492/30, 28, 33, 34, 35, 36
See application file for complete search history.

(56) References Cited

U.S. PATENT DOCUMENTS

| | | | | |
|---|---|---|---|---|
| 8,833,687 | B2 * | 9/2014 | Harbold | B02C 4/305 241/293 |
| 2005/0117984 | A1 * | 6/2005 | Eason | E21B 10/56 428/500 |
| 2011/0011965 | A1 * | 1/2011 | Mirchandani | B22F 7/062 241/277 |
| 2016/0101425 | A1 * | 4/2016 | Drepper | B02C 4/305 241/294 |

FOREIGN PATENT DOCUMENTS

| | | | |
|---|---|---|---|
| WO | 2014173877 | A2 | 10/2014 |
| WO | 2014173877 | A3 | 10/2014 |
| WO | 2019/156558 | A1 | 8/2019 |
| WO | 2019/156558 | A8 | 8/2019 |

* cited by examiner

ROLL FOR A ROLLER PRESS, AS WELL AS A ROLLER PRESS PROVIDED WITH SUCH A ROLL

CROSS REFERENCE TO RELATED APPLICATIONS

The present application is a 371 U.S. National Phase Entry of pending International Application No. PCT/NL2019/050077, filed Feb. 7, 2019, which claims priority to NL2020403, filed Feb. 8, 2018, each of which are herein incorporated by reference in their entireties.

BACKGROUND OF THE INVENTION

The invention relates to a roll for a roller press suitable for comminution of granular material by interparticle crushing, as well as a roller press provided with such a roll.

Such a roll as well as such a roller press is for example disclosed in U.S. Pat. No. 5,269,477 and is implemented for comminution of granular material by interparticle crushing. Granular material is fed into the nip between two opposing rotatable rollers, which are rotating in opposite directions. Under friction the material is compressed between the roller surfaces with the application of an extremely high pressure.

In this operation, the outer cylindrical pressing surfaces of each roll are exposed to extraordinarily high stressing and high wear. An improvement which has been done is to armor the roller surfaces with a wear-resistant cladding to provide a hardened outer surface.

Furthermore, in order to improve the draw-in capability of the pressing rollers that must draw the granular material product into the nip by friction and compress it, it is known to provide the outer cylindrical pressing surface of the roll with a plurality of outwardly extending wear-resistant surface studs. The granular material being drawn-in and captured between the studs forms an autogenous layer, which provides a protecting layer for the outer cylindrical pressing surface of the roll.

However, in certain applications and under specific operational conditions the autogenous layer starts to displace or flow between the outwardly extending wear-resistant surface studs. This flow of granular material has a low velocity relative to the roll and can cause excessive wear to the base material of the outer cylindrical pressing surface of the roll, instead of protecting it. This autogenous layer flow limits the life span of the roll and the roller press significantly, but also disrupts the comminution of the granular material by interparticle crushing in the nip between the opposing rolls.

It is an object of the present invention to provide a roll design as well as a roller press, which do not suffer from the above identified drawback.

In an example a roll according to the invention the cylindrical body of the roll is provided with means for restricting the flow of granular material between the outwardly extending wear-resistant surface studs along the outer cylindrical pressing surface.

Herewith excessive wear to the base material of the outer cylindrical pressing surface of the roll is significantly reduced or even prevented, as well as the comminution of the granular material by interparticle crushing in the nip between the opposing rolls is no longer disrupted.

In a further example the flow restricting means are fitted at positions on the pressing surface, where the possibility of flow of granular material in a rotational direction along the outer cylindrical pressing surface exists, whereas in another example the flow restricting means are fitted at positions on the pressing surface, where the possibility of flow of granular material in a longitudinal direction along the outer cylindrical pressing surface exists.

In both examples the autogenous layer of granular material present between the outwardly extending wear-resistant surface studs is prevented to fluidize because of the presence of the flow restricting means, thus preventing excessive wear to the base material of the outer cylindrical pressing surface of the roll.

In yet a further advantageous example the flow restricting means extends in a longitudinal direction along the outer cylindrical pressing surface. Herewith any erosive flow of autogenous layer of granular material in a rotational direction along the circumference of the outer cylindrical pressing surface is prevented.

In another advantageous example of the roll according to the invention the flow restricting means extends in a rotational direction along the outer cylindrical pressing surface. Herewith any flow of autogenous layer of granular material in a longitudinal direction along the circumference of the outer cylindrical pressing surface in the direction of the end faces thereof is prevented.

In a design example of the roll, the plurality of outwardly extending wear-resistant surface studs are positioned in a pattern consisting of parallel extending lines on the pressing surface and wherein the flow restricting means are provided between adjacent pattern lines.

An example of the roll according to the invention has the design, wherein the flow restriction means are made of one or more strip-like elements provided on the outer cylindrical pressing surface of the cylindrical body. In particular the strip-like flow restriction means are composed of a first strip-like element positioned in a longitudinal direction on the outer cylindrical pressing surface of the cylindrical body (of the roll) and at least a further strip-like element positioned at an inclined orientation relative to the first strip-like element. With this example any damaging, erosive flow of the autogenous layer of granular layer in a rotational as well as in a longitudinal direction along the circumference of the outer cylindrical pressing surface is prevented.

In yet another advantageous example, the strip-like flow restriction means are composed of a series of strip-like elements positioned in a zig-zag orientation on the outer cylindrical pressing surface of the cylindrical body. This example of the flow restriction means is in particular useful for application on the outer cylindrical pressing surface of the roll having a more dense or an irregular pattern of outwardly extending wear-resistant surface studs.

Furthermore preferably, the wear-resistant surface studs are made from a material being harder than the material of the outer cylindrical pressing surface.

Also the flow restricting means can be made from a hard metal mixture, e.g. Tungsten Carbide based mixtures.

BRIEF DESCRIPTION OF THE DRAWINGS

The invention will now be described in more details in reference to accompanying drawings, which drawings show in.

DETAILED DESCRIPTION OF THE INVENTION

Figure 1:
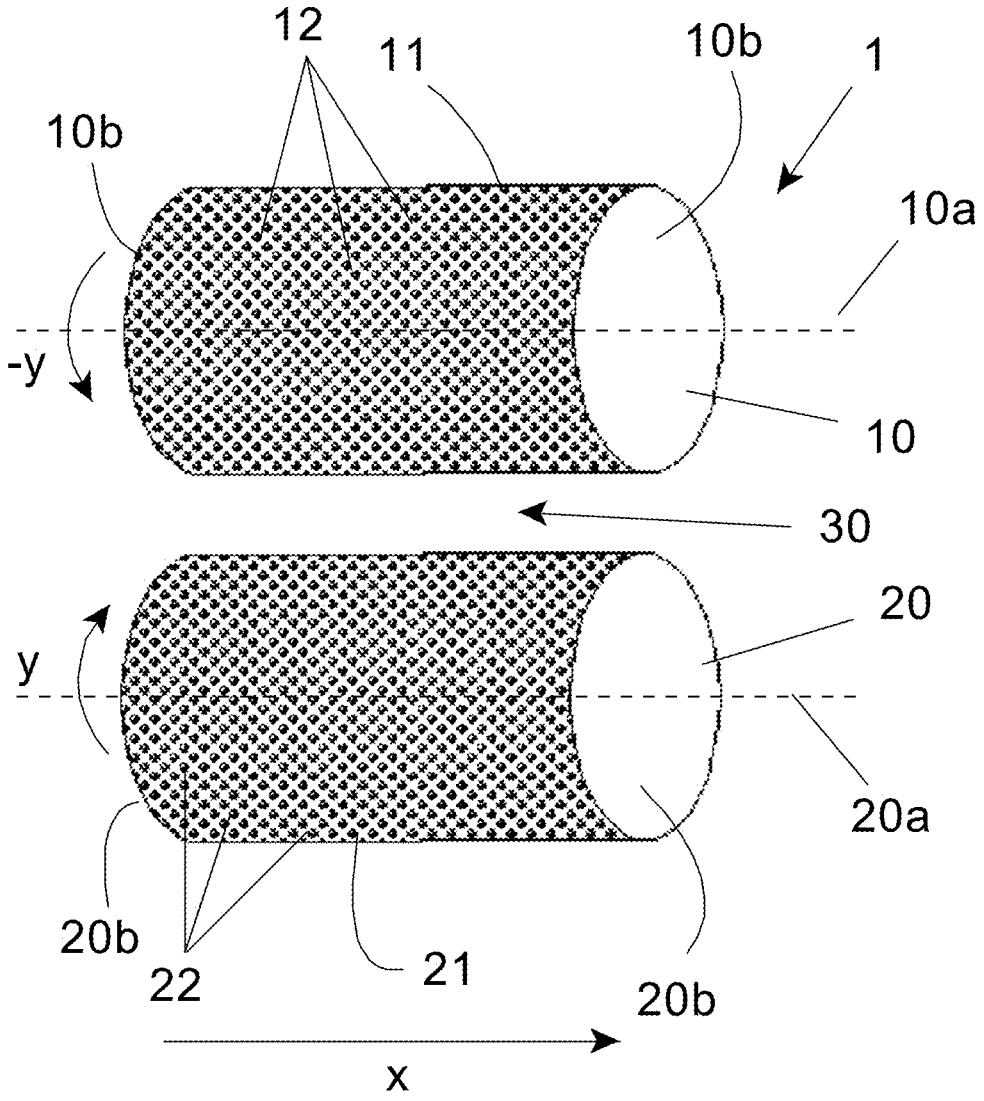
Fig. 1 PRIOR ART
FIG. 1 a schematic embodiment of a roller press consisting of a set of two opposing rolls according to the state of the art.

For a better understanding of the invention like parts in the drawings are be denoted with like reference numerals.

FIG. 1 depicts in a schematic manner a roller press 1 suitable for comminution of granular material by interparticle crushing according to the state of the art. Such a roller press 1 is to be used for comminution or grinding of granular material by interparticle crushing and is composed of a set of two opposing rolls or rollers 10 and 20 respectively. Each roll 10-20 is composed of a cylindrical body having a longitudinal length dimension x and having an outer cylindrical pressing surface 11-21 and side faces 10*b*-20*b*.

Each roll 10-20 can be rotated around their longitudinal axis of rotation 10*a*-20*a* using suitable (non-depicted) roll driving means. For a proper operation of the roller press 1, both rolls 10-20 of the set of rolls are rotated in opposite rotational directions, as shown by the rotational arrows y and −y on the left of FIG. 1.

Both rolls 10-20 are orientated parallel from each other in their longitudinal orientation and at some distance from each other, as shown in FIG. 1. The distanced orientation as shown in FIG. 1 creates a space between the two opposing outer cylindrical pressing surfaces 11-21 of both cylindrical bodies, which space is denoted with reference numeral 30 and also indicated as an interparticle crushing pressing nip.

During operation of the roller press granular material, which for example is being processed in the mining or cement/mortar industry, is fed into the nip 30 between the two opposing rotatable rollers 10-20, which are rotating in opposite directions y and −y. Under friction the granular material is compressed between the roller surfaces 11-21 with the application of extremely high pressures, thereby reducing the solid materials to a smaller average particle size.

During this type of mineral processing, the outer cylindrical pressing surfaces 11-21 of each roll 10-20 are exposed to extraordinarily high stressing and high wear. An improvement which has been done is to armor the roller surfaces 11-21 with a wear-resistant cladding (not shown) to provide a hardened outer surface.

In addition, in order to improve the draw-in capability of the pressing rollers 10-20 that must draw the granular material product into the nip 30 by friction and compress it, it is known to provide the outer cylindrical pressing surface 11-21 of each counter-rotating roll 10-20 with a plurality of outwardly extending wear-resistant surface studs 12-22. Usually the outwardly extending wear-resistant surface studs 12-22 are made from a material being harder than the material of the outer cylindrical pressing surface 11-21 and the studs 12-22 extends at a height h of approx. 5-10 mm from the surface 11-21.

Figure 2:
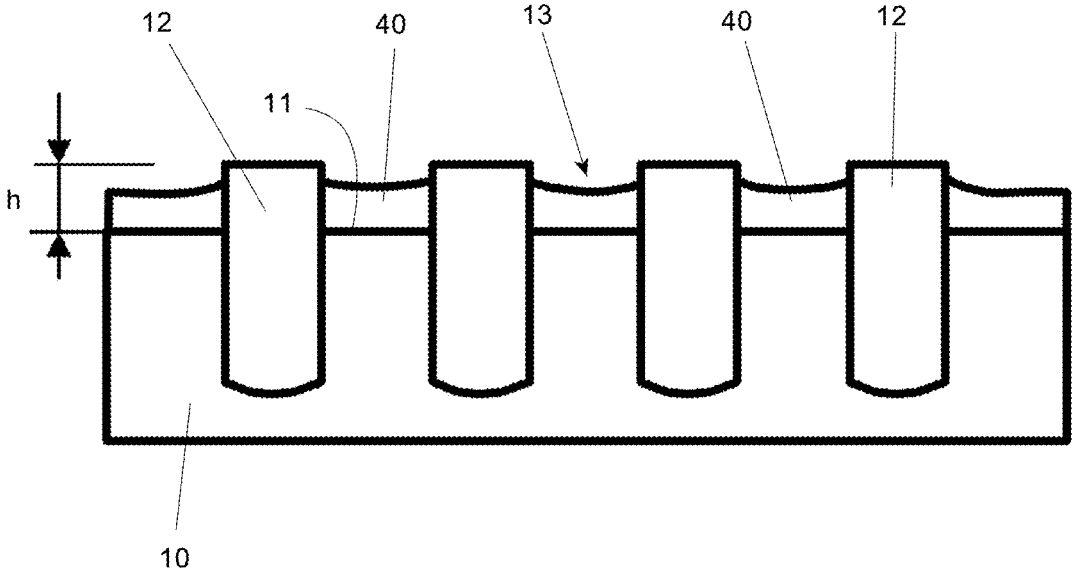
Fig. 2 PRIOR ART
FIG. 2 a schematic cross sectional detail of the roll of FIG. 1.

The granular material being drawn-in and captured in the spaces 13-23 between the studs 12-22 forms an autogenous layer 40, which provides a protecting layer for the outer cylindrical pressing surface 11-22 of the roll 10-20. See FIG. 2. Herewith the lifespan of the roll 10-20 is extended and the comminution of granular material by interparticle crushing is improved.

However, in certain applications and under specific operational conditions the autogenous layer 40 starts to displace or flow in the spaces 13-23 between the outwardly extending wear-resistant surface studs 12-22. This flow of granular material is depicted in FIG. 3 with arrows 40*a* and 40*b* and is opposite to the direction of rotation (−y or y) of the respective roll (10 or 20).

Figure 3:
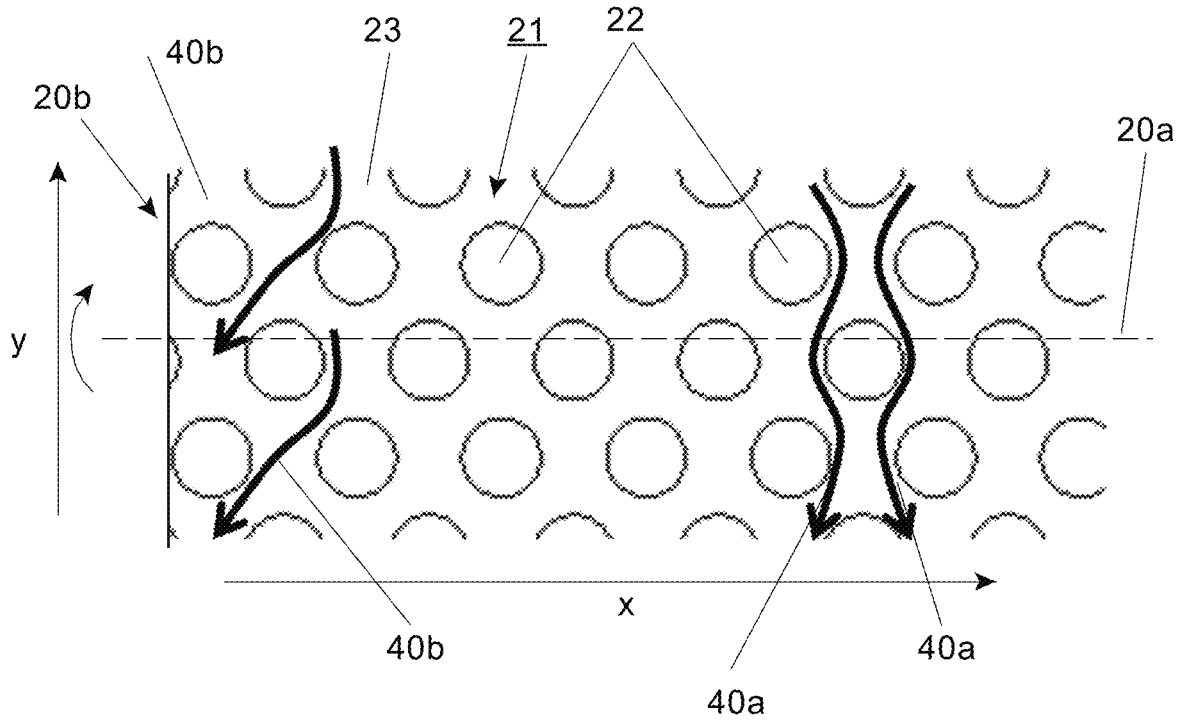
Fig. 3 PRIOR ART
FIG. 3 a schematic detail of the flow of the autogenous layer of granular material across the cylindrical surface of the roll of FIG. 1.

In this example FIG. 3 depicts roll 20 of the roller press of FIG. 1, and as such flow arrows 40*a* denote an autogenous material flow in rotational direction opposite to the rotational direction y of the roll 20 around its longitudinal axis 20*a* across the outer cylindrical pressing surface 22 of the roll 20, whereas flow arrows 40*b* denote an autogenous material flow in a (more or less skewed) longitudinal direction x across the outer cylindrical pressing surface 11-22 of the roll 10-20 in the direction x (or its opposite direction −x) of the side faces 10*b*-20*b* of the roll 10-20.

The autogenous material flows 40*a*-40*b* exhibit a low velocity relative to the roll surface 11-22 and can cause excessive wear to the base material of the outer cylindrical pressing surface 11-22 of the roll 10-20, instead of protecting it. This autogenous layer flow 40*a*-40*b* thus limits the life span of the roll 10-20 and the roller press 1 significantly, but also disrupts the comminution of the granular material by interparticle crushing in the nip 30 between the opposing rolls 10-20.

Figure 4:
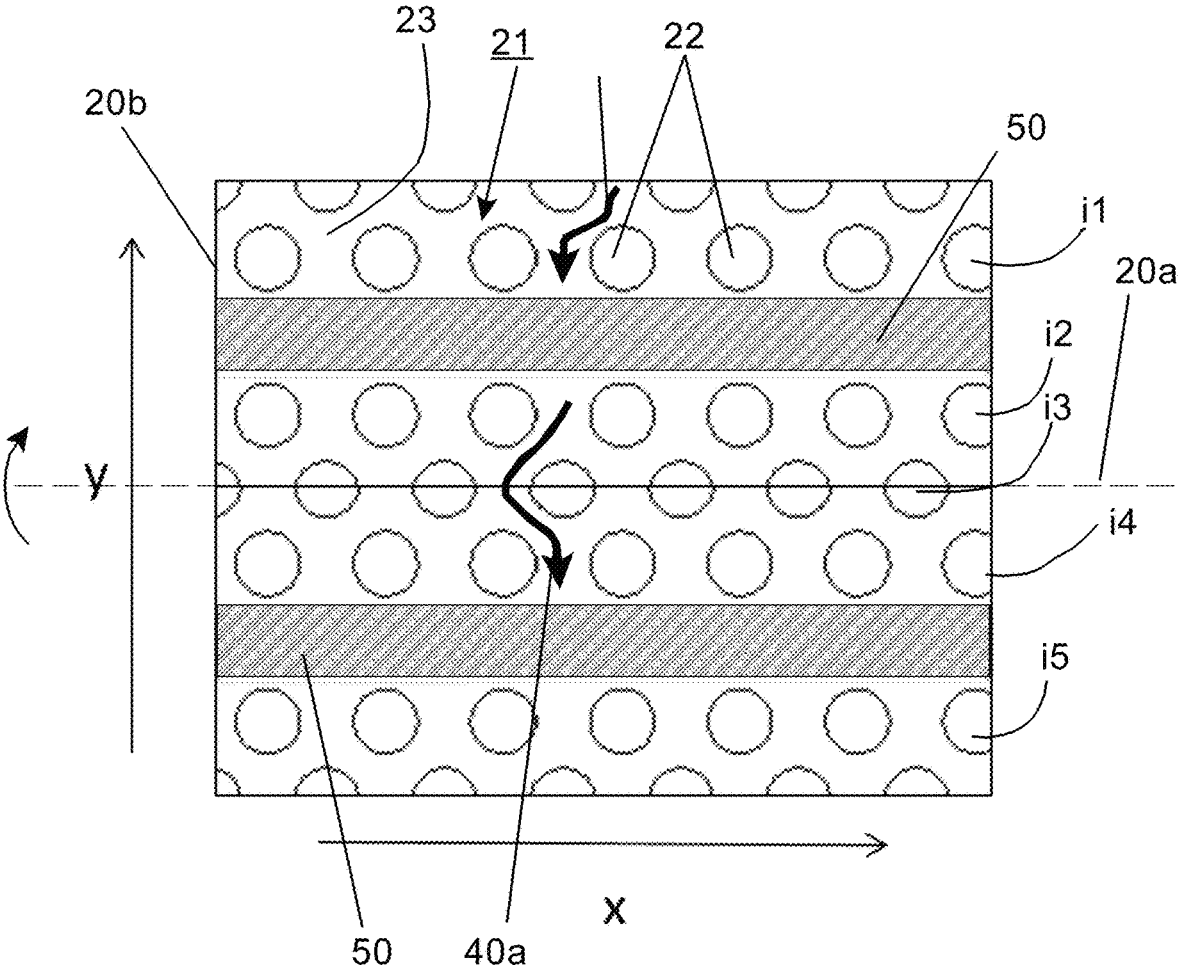
FIG. 4 a first embodiment of a roll provided with flow restriction means according to the invention.

As a solution for the above described phenomenon of autogenous layer flow FIG. 4 depicts an example of a roll 10-20 according to the invention. In this Figure roll 20 is depicted as can be observed from its rotational direction y (see also FIG. 1). The cylindrical body of the roll 10-20 is provided with means 50 for restricting the flow of granular material in the spaces 13-23 between the outwardly extending wear-resistant surface studs 12-22 along the outer cylindrical pressing surface 11-21.

In particular the flow restricting means 50 are fitted at positions on the pressing surface 11-21, where the possibility of flow 40*a* of granular material in a rotational direction opposite the rotational direction y of the roll 10-20 along the outer cylindrical pressing surface 11-21 exists, whereas in another example the flow restricting means 50 are fitted at positions on the pressing surface 11-21, where the possibility of flow 40*b* of granular material in a longitudinal direction x (or −x) along the outer cylindrical pressing surface 11-21 exists.

Figure 5:
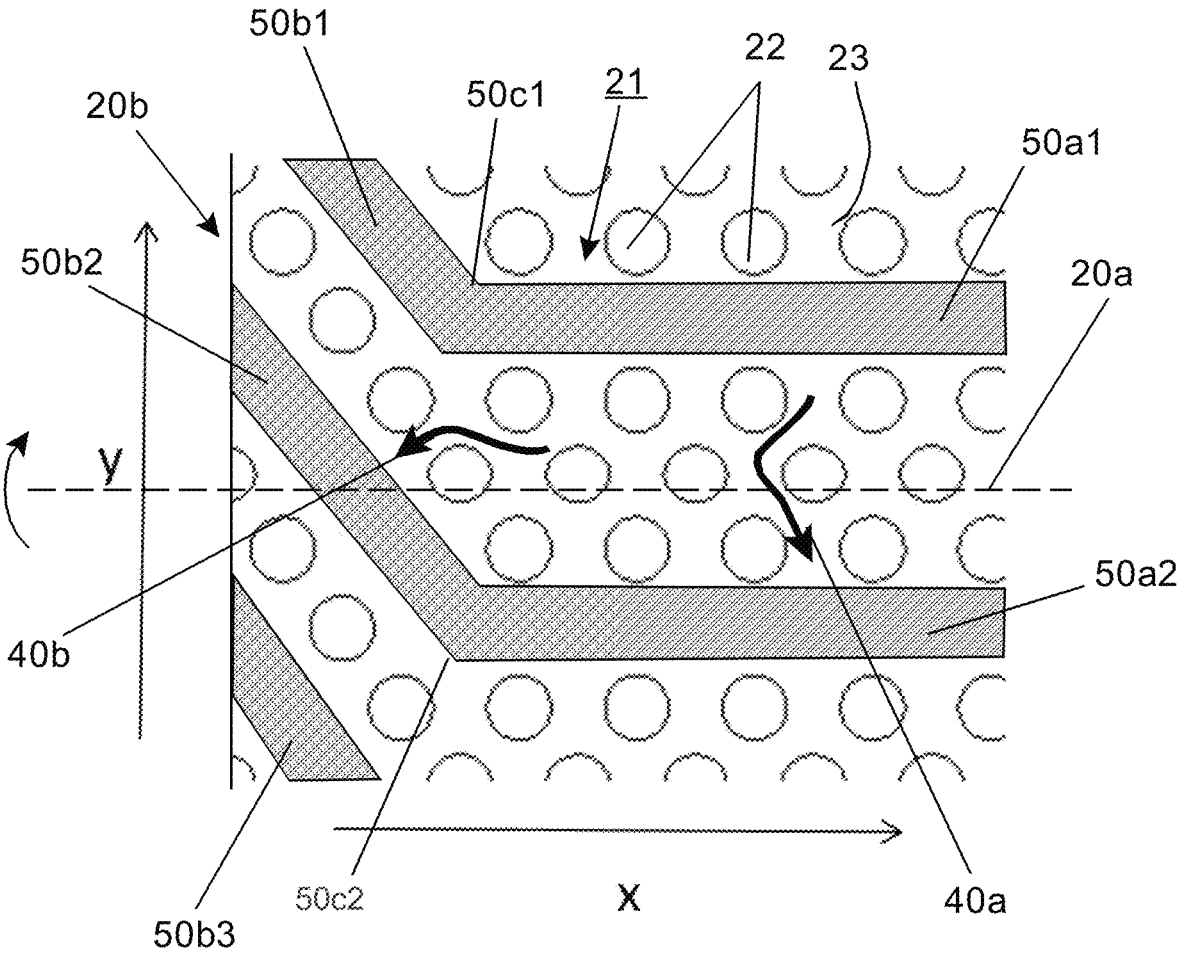
FIG. 5 a second embodiment of a roll provided with flow restriction means according to the invention.
Figure 6:
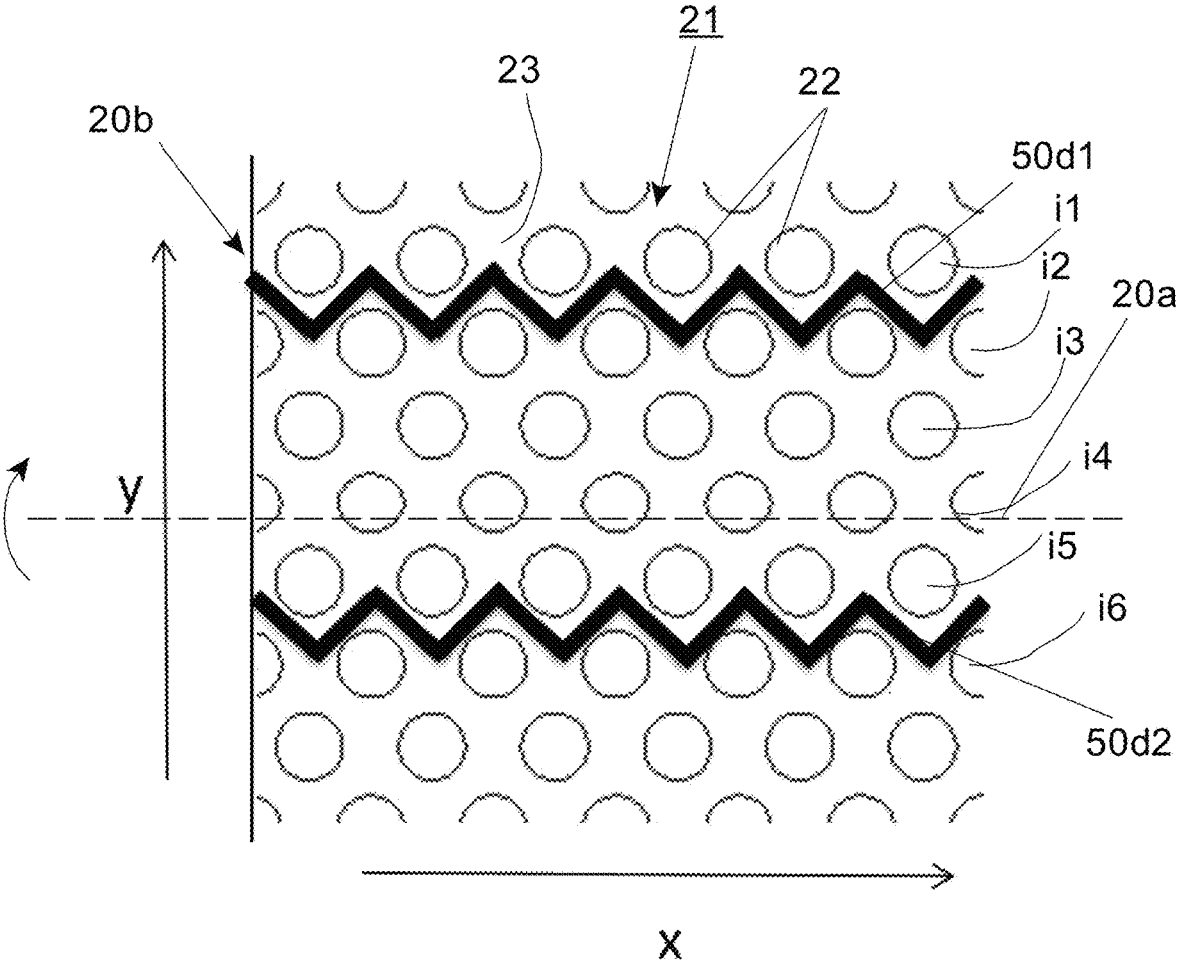
FIG. 6 a third embodiment of a roll provided with flow restriction means according to the invention.
Figure 7:
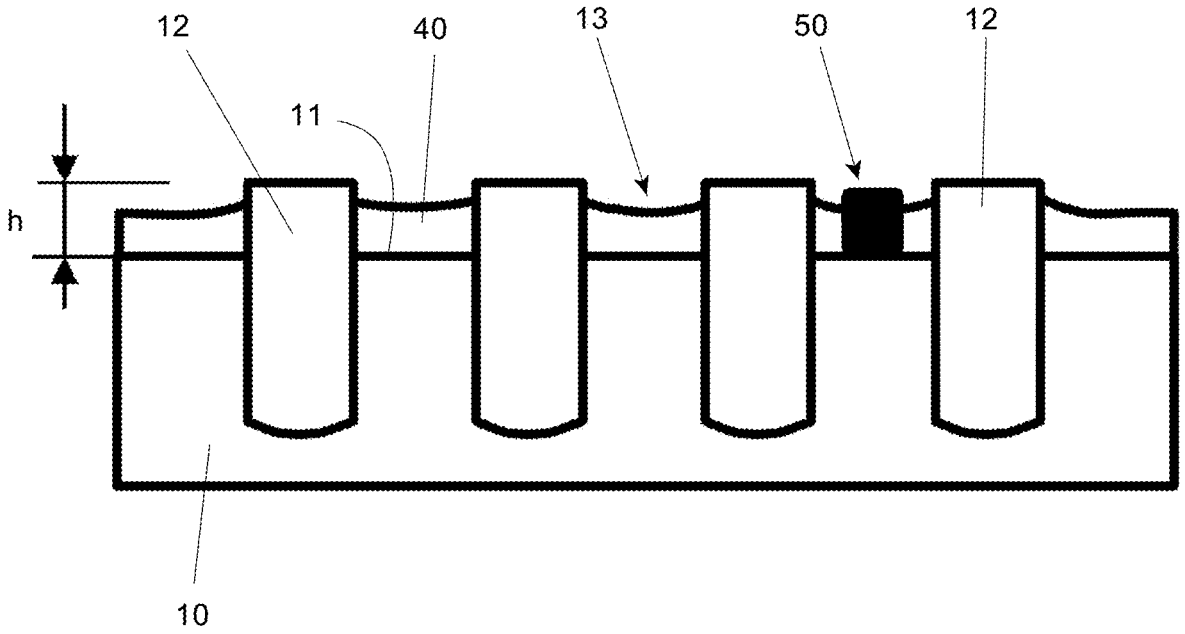
FIG. 7 a schematic cross sectional detail of the roll of FIG. 4.

Embodiments of these example are shown in FIGS. 4-5-6. In FIG. 4 the plurality of outwardly extending wear-resistant surface studs 12-22 are positioned in a pattern consisting of parallel extending pattern lines i1-i2-i3-i4-i5-etc.-etc. on the pressing surface 11-21 and the flow restricting means 50 are provided between adjacent pattern lines, here between pattern lines i1 and i2 and between pattern lines i4 and i5. See also FIG. 7.

In this the design the flow restriction means are made of one or more strip-like elements 50 provided on the outer cylindrical pressing surface 11-21 of the cylindrical body of the roll 10-20. In particular the strip-like flow restriction means 50 are composed of assembly-strip consisting of a first strip-like element 50*a*1-50*a*2-etc.-etc. positioned in a longitudinal direction x on the outer cylindrical pressing surface 11-21 of the cylindrical body (of the roll 10-20) and at least a further strip-like element 50*b*1-50*b*2-50*b*3-etc.-etc. positioned at an inclined orientation relative to the first strip-like element 50*a*1-50*a*2-etc.-etc. Both the first strip-like element 50*a*1-50*a*2-etc.-etc. and the at least further strip-like element 50*b*1-50*b*2-50*b*3-etc.-etc. are interconnected or converge at their connections 50*c*1-50*c*2-etc.-etc. With this example any damaging, erosive flow of the autogenous layer 40 of granular layer in a rotational direction y (flow arrow 40*a*) as well as in a (more or less) longitudinal direction x (flow arrow 40*b*) towards the side faces 10*b*-20*b* of the roll 10-20 along the circumference (seen in rotational or longitudinal direction) of the outer cylindrical pressing surface 11-21 is prevented.

Another advantageous example is shown in FIG. 6, wherein the strip-like flow restriction means 50 are composed of a series of strip-like elements 50*d*1-50*d*2 positioned in a zig-zag orientation between the outwardly extending wear-resistant surface studs 12-22 on the outer cylindrical pressing surface 11-21 of the cylindrical body. This example of the flow restriction means 50*d*1 is in particular useful for application on the outer cylindrical pressing surface 11-21 of the roll 10-20 having a more dense or an irregular pattern of outwardly extending wear-resistant surface studs 12-22. Also in this example the pattern of outwardly extending wear-resistant surface studs 12-22 is composed of closely positioned pattern lines i1-i2-i3-i4-i5-i6-etc.-etc., with the zig-zag orientated strip-like elements 50*d*1-50*d*2 being positioned between pattern lines i1-i2 and i5-i6.

With the examples above excessive wear to the base material of the outer cylindrical pressing surface 11-21 of the roll 10-20 is significantly reduced or even prevented, as well as the comminution of the granular material by interparticle crushing in the nip 30 between the opposing rolls 10-20 is no longer disrupted. Furthermore the autogenous layer 40 of granular material present in the spaces 13-23 between the outwardly extending wear-resistant surface studs 12-22 is prevented to fluidize because of the presence of the flow restricting means 50 (50*a*1-50*a*2-etc.; 50*b*1-50*b*2-etc.; 50*d*1-50*d*2-etc.), thus preventing erosive flow 40*a*-40*b* and excessive wear to the base material of the outer cylindrical pressing surface of the roll 10-20.

Preferably, the flow restricting means can be made from a hard metal mixture, e.g. Tungsten Carbide based mixtures.

LIST OF REFERENCE NUMERALS

1 Roller press
10/20 First/second roll of set of rollers
10*a*/20*a* Axis of rotation
10*b*/20*b* Side face of cylindrical body of roll
11/21 Outer cylindrical pressing surface of cylindrical body
12/22 Outwardly extending wear-resistant surface stud
13/23 Space between adjacent outwardly extending wear-resistant surface studs
30 Nip between first and second roll
40 Autogenous layer of granular material
40*a* Flow of granular material between the surface studs in circumferential direction
40*b* Flow of granular material between the surface studs in longitudinal direction (in the direction of the side faces)
50 Means for restricting the flow of granular material (first embodiment)
50*a*1-2 first strip element of flow restriction means (second embodiment)
50*b*1-2-3 Second strip element of flow restriction means (second embodiment)
50*c*1-*c*2 Interconnection between first and second strip-elements
i1-i2-etc. pattern lines of studs on the pressing surface

The invention claimed is:

1. A roll for a roller press suitable for comminution of granular material by interparticle crushing, said roll comprising:

a cylindrical body having an outer cylindrical pressing surface for use with an opposing roll in an interparticle crushing pressing nip;

a plurality of outwardly extending wear-resistant surface studs positioned on the pressing surface; wherein the cylindrical body is provided with a flow restricting means for restricting a flow of granular material between the outwardly extending wear-resistant surface studs along the outer cylindrical pressing surface, wherein the plurality of outwardly extending wear-resistant surface studs are positioned in a pattern consisting of a plurality of parallel extending lines on the pressing surface and wherein the flow restricting means is provided between and extends parallel to adjacent ones of the plurality of parallel extending lines, and wherein the flow restricting means includes a strip element provided on the outer cylindrical pressing surface of the cylindrical body; wherein the strip element extends a majority of a longitudinal length of the cylindrical body.

2. A roll according to claim 1, wherein the flow restricting means extends in a longitudinal direction along the outer cylindrical pressing surface.

3. A roll according to claim 1, wherein the flow restricting means extends in a rotational direction along the outer cylindrical pressing surface.

4. A roll according to claim 1, wherein the strip element includes a first portion positioned in a longitudinal direction on the outer cylindrical pressing surface of the cylindrical body and a second portion positioned at an inclined orientation relative to the first portion.

5. A roll according to claim 1, wherein the strip element includes a series of portions positioned in a zig-zag orientation on the outer cylindrical pressing surface of the cylindrical body.

6. A roll according to claim 1, wherein the wear-resistant surface studs are made from a material being harder than the material of the outer cylindrical pressing surface.

7. A roll according to claim 1, wherein the flow restricting means are made from a hard metal mixture.

8. A roller press suitable for comminution of granular material by interparticle crushing, said roller press comprising:

at least one set of two opposing rolls, each roll consisting of a cylindrical body having an outer cylindrical pressing surface for use with the opposing roll in an interparticle crushing pressing nip; wherein at least one roll is provided according to claim 1.

9. A roll according to claim 7, wherein the hard metal mixture is a Tungsten Carbide based mixture.

10. A roll according to claim 1, wherein the strip element extends the entire longitudinal length of the cylindrical body.

11. The roll according to claim 1, wherein the strip element is configured to prevent accumulated material from fluidizing and displacing along the outer cylindrical pressing surface.

* * * * *